US007595591B2

(12) United States Patent
Yoo et al.

(10) Patent No.: US 7,595,591 B2
(45) Date of Patent: Sep. 29, 2009

(54) PLASMA DISPLAY PANEL

(75) Inventors: Young-Gil Yoo, Suwon-si (KR); Gun-Young Hong, Suwon-si (KR)

(73) Assignee: Samsung SDI Co., Ltd., Suwon-Si (KR)

( * ) Notice: Subject to any disclaimer, the term of this patent is extended or adjusted under 35 U.S.C. 154(b) by 428 days.

(21) Appl. No.: 11/698,574

(22) Filed: Jan. 25, 2007

(65) Prior Publication Data

US 2007/0176556 A1 Aug. 2, 2007

(30) Foreign Application Priority Data

Jan. 27, 2006 (KR) ..... 10-2006-0009025

(51) Int. Cl.
*H01J 17/49* (2006.01)

(52) U.S. Cl. ..... 313/582; 313/584

(58) Field of Classification Search ..... 313/582–584
See application file for complete search history.

(56) References Cited

FOREIGN PATENT DOCUMENTS

KR 2007056586 A * 6/2007

* cited by examiner

*Primary Examiner*—Vip Patel
(74) *Attorney, Agent, or Firm*—Knobbe Martens Olson & Bear LLP

(57) ABSTRACT

Provided is a plasma display panel that includes a plurality of substrates disposed facing each other, a plurality of discharge electrodes disposed within the substrates and a predetermined discharge voltage is applied to the discharge electrodes, barrier ribs which are disposed between the substrates and define discharge cells, and a plurality of phosphor layers coated in the discharge cells to emit a plurality of colors for color images, wherein a raw material for forming at least one phosphor layer of the phosphor layers is mixed in the barrier ribs. The plasma display panel can increase luminous efficiency of discharge cells that have low luminous efficiency and can increase color temperature at full white.

13 Claims, 2 Drawing Sheets

PLASMA DISPLAY PANEL

CROSS-REFERENCE TO RELATED PATENT APPLICATION

This application claims the benefit of Korean Patent Application No. 10-2006-0009025, filed on Jan. 27, 2006, in the Korean Intellectual Property Office, the disclosure of which is incorporated herein in its entirety by reference.

BACKGROUND OF THE INVENTION

1. Field of the Invention

The present embodiments relate to a plasma display panel, and more particularly, to a plasma display panel in which color temperature is compensated by mixing a phosphor raw material having low luminous efficiency within barrier ribs.

2. Description of the Related Art

Conventionally, a plasma display panels is a flat display device that displays desired numbers, letters, or a graphic by exciting a phosphor material in a phosphor layer using ultraviolet rays generated by discharge of a discharge gas filled between two substrates on which a plurality of electrodes are formed.

A conventional three-electrode surface discharge type plasma display panel has the following structure.

The plasma display panel includes front and rear substrates. An X electrode and a Y electrode are alternately formed on an inner surface of the front substrate, and the X and Y electrodes are buried by a front dielectric layer. A protective layer is formed on a surface of the front dielectric layer. A plurality of address electrodes are formed on an inner surface of the rear substrate in a direction crossing the X and Y electrodes. The address electrodes are buried by a rear dielectric layer. A plurality of barrier ribs that define a plurality of discharge cells are disposed between the front and rear substrates. Phosphor layers of red, green, and blue colors are coated in the barrier ribs.

In a conventional plasma display panel having the above configuration, when an electrical signal is applied between the address electrodes and the Y electrode, discharge cells for generating light are selected, and when an electrical signal is alternately applied to the X and Y electrodes, visible light is emitted from the phosphor layers coated in the selected discharge cells, thereby displaying a stationary image of a moving image.

However, the conventional plasma display panel has a drawback of low color temperature since the blue color phosphor layer has relatively low luminous efficiency compared to the red and green color phosphor layers.

Therefore, various methods for increasing the luminous efficiency of the blue color phosphor layer have been studied. For example, some methods that have been used include forming the coating area of the blue color phosphor layer greater than the coating area of the red and green color phosphor layers, or increasing the brightness of the blue color phosphor layer by using a blue color filter separately provided.

However, the increase in the coating area of the blue color phosphor layer to be greater than the coating area of the red and green color phosphor layers causes non-uniformity of discharge cells. Also, the increase in the luminous efficiency of the blue color phosphor layer using an additional blue color filter complicates the structure of the plasma display panel.

SUMMARY OF THE INVENTION

The present embodiments provide a plasma display panel in which color temperature is compensated for by mixing a blue phosphor raw material having low luminous efficiency within the barrier ribs.

According to an aspect of the present embodiment, there is provided a plasma display panel comprising: a plurality of substrates disposed facing each other; a plurality of discharge electrodes disposed within the substrates and a predetermined discharge voltage is applied to the discharge electrodes; barrier ribs which are disposed between the substrates and define discharge cells; and a plurality of phosphor layers coated in the discharge cells to emit a plurality of colors for color images, wherein a raw material for forming at least one phosphor layer of the phosphor layers is mixed in the barrier ribs.

The raw material for forming the phosphor layer that has relatively low luminous efficiency may be mixed in the barrier ribs.

The phosphor layers may comprise red, green, and blue phosphor layers, and the raw material for forming a phosphor layer mixed with the barrier ribs may be a raw material for forming a blue color phosphor layer.

The raw material for forming a blue color phosphor layer may be mixed in the barrier ribs that define the blue color discharge cells.

The raw material for forming a blue color phosphor layer may be mixed in throughout the barrier ribs that the define discharge cells.

According to another aspect of the present embodiment, there is provided a plasma display panel comprising: a front substrate; a rear substrate facing the front substrate; a plurality of discharge electrodes disposed in he front and rear substrates and a predetermined discharge voltage is applied to the discharge electrodes; a dielectric layer that buries the discharge electrodes; a protective layer formed on the surface of the dielectric layer; barrier ribs disposed between the front and rear substrate to define discharge cells; and phosphor layers of red, green, and blue color coated in the discharge cells, wherein a raw material for forming at least one phosphor layer of the phosphor layers of red, green, and blue color is mixed in the barrier ribs.

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION OF THE INVENTION

The present embodiments will now be described more fully with reference to the accompanying drawings in which exemplary embodiments are shown.

Figure 1:
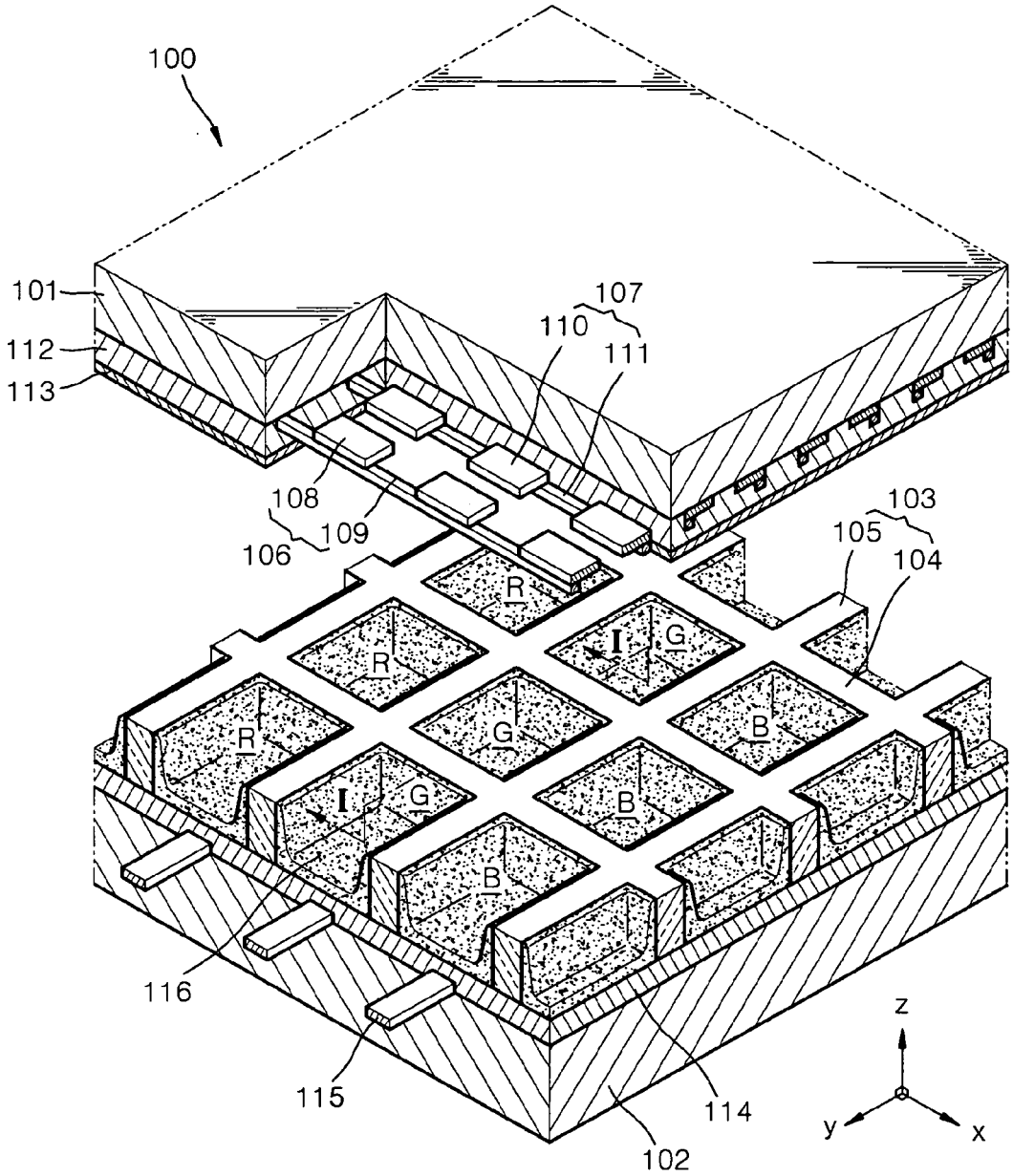
FIG. 1 is a partial cutaway exploded perspective view illustrating a plasma display panel according to an embodiment.
Figure 2:
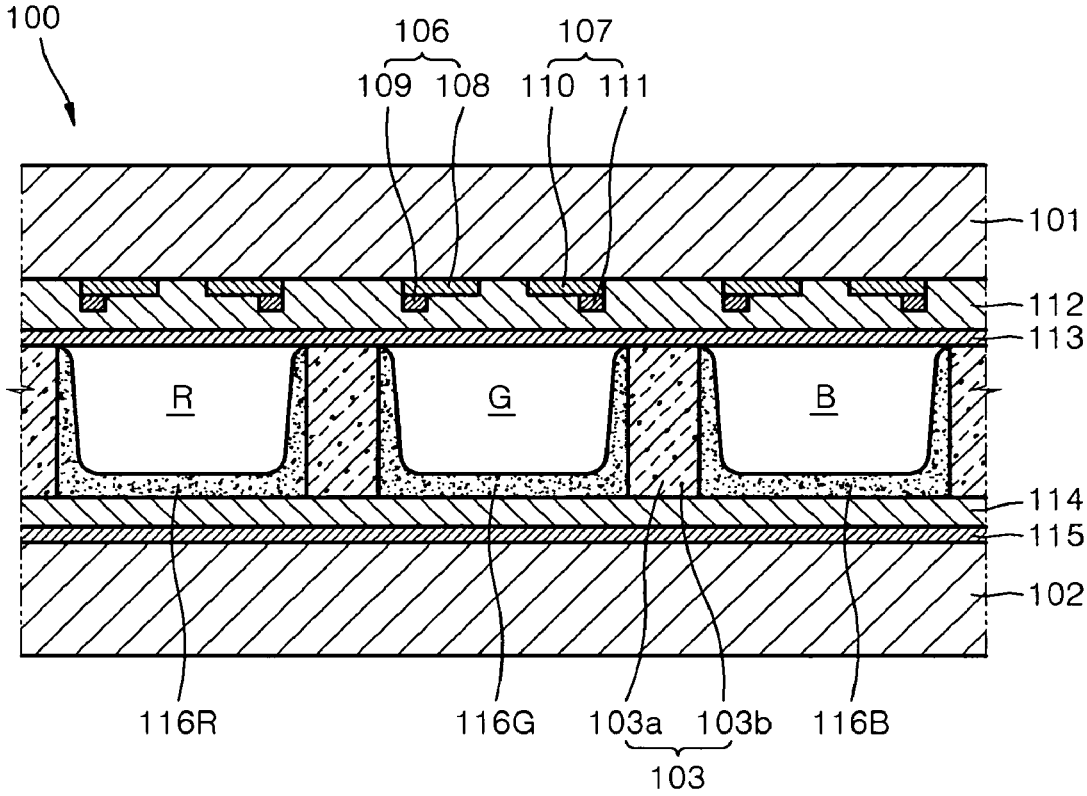
FIG. 2 is a cross-sectional view taken along a line I-I according to the present embodiment of FIG. 1.

FIG. 1 is a partial cutaway exploded perspective view illustrating a plasma display panel 100 according to an embodiment, and FIG. 2 is a cross-sectional view taken along a line I-I of FIG. 1.

Referring to FIGS. 1 and 2, the plasma display panel 100 includes a front substrate 101 and a rear substrate 102 disposed parallel to the front substrate 101. The front substrate 101 and the rear substrate 102 seals a discharge space from the outside by frit glass (not shown) coated along edges of surfaces of the front and rear substrates 101 and 102 facing each other.

The front substrate 101 is a transparent substrate formed of soda lime glass. Alternately, the front substrate 101 can be a semi-transparent plate, a colored substrate, or a reflection plate. The rear substrate 102 can also be formed of substantially the same material as the front substrate 101.

Barrier ribs 103 that define a plurality of discharge cells together with the front and rear substrates 101 and 102 are disposed between the front and rear substrates 101 and 102. The barrier ribs 103 include first barrier ribs 104 disposed in an X direction of the plasma display panel 100 and second barrier ribs 105 disposed in a Y direction of the plasma display panel 100. The barrier ribs 103 define the discharge cells in a lattice type.

Alternatively, the barrier ribs 103 can be arranged to various types such as, for example, a meander type, a delta type, a waffle type, or a honeycomb type. The discharge cells defined by the barrier ribs 103 can have various shapes of horizontal cross-section such as, for example, a polygon shape, a circle, or an oval shape in addition to the rectangular shape as in the current embodiment.

An X electrode 106 and a Y electrode 107 are disposed on an inner surface of the front substrate 101 along the X direction of the plasma display panel 100. The X and Y electrodes 106 and 107 are alternately disposed along the Y direction of the plasma display panel 100.

The X electrode 106 includes first transparent electrodes 108 formed on an inner surface of the front substrate 101 and a first bus electrode 109 that electrically connects the transparent electrodes 108. The cross-section of the first transparent electrodes 108 is a rectangular shape, but the present embodiment is not limited thereto.

The Y electrode 107 has a shape substantially identical to the X electrode 106, and includes second transparent electrodes 110 formed on an inner surface of the front substrate 101 and a second bus electrode 111 that electrically connects the second transparent electrodes 110. The second transparent electrodes 110 are disposed in each of the discharge cells in a rectangular shape, but the shape of the second transparent electrodes 110 is not limited thereto. The second transparent electrode 110 is separated a predetermined distance from the first transparent electrode 108 in the discharge cell to form a discharge gap.

In order to increase the opening ratio of the front substrate 101, the first and second transparent electrodes 108 and 110 are formed of a transparent conductive film, for example, indium tin oxide (ITO). The first and second bus electrodes 109 and 111 are formed in multiple layers using a metal having high conductivity, for example, an Ag paste or a Cr—Cu—Cr alloy to increase the electrical conductivity of the first and second transparent electrodes 108 and 110.

A space between a pair of the X and Y electrodes 106 and 107 and adjacent pair of the X and Y electrodes 106 and 107 corresponds to a non-discharge region. A black stripe layer can further be formed on the non-discharge region to increase contrast of the plasma display panel 100.

The X and Y electrodes 106 and 107 are contained within a front dielectric layer 112. The front dielectric layer 112 is formed of a high dielectric material, for example, ZnO—$B_2O_3$—$Bi_2O_3$. The front dielectric layer 112 can be selectively printed on portions where the X and Y electrodes 106 and 107 are formed or can be printed on the entire surface of the front substrate 101.

A protective layer 113 formed of, for example, MgO is deposited on a surface of the front dielectric layer 112 to prevent the damage of the front dielectric layer 112 and to increase the emission of secondary electrons.

A plurality of address electrodes 115 are disposed on an inner surface of the rear substrate 102. The address electrodes 115 are disposed in a direction crossing the X and Y electrodes 106 and 107. The address electrodes 115 are buried by a rear dielectric layer 114. The rear dielectric layer 114 is formed of a high dielectric material, for example, PbO—$B_2O_3$—$SiO_2$.

A discharge gas such as, for example, a Ne—Xe gas or a He—Xe gas is filled in the discharge cells defined by the coupling of the first substrate 101, the second substrate 102, and the barrier rib 103.

A plurality of phosphor layers 116 that emit colored visible light when the phosphor layers 116 are excited by ultraviolet rays generated from the discharge gas are formed in the discharge cells. The phosphor layers 116 can be coated on any region of the discharge cells, and, in the current embodiment, the phosphor layers 116 are coated to a predetermined thickness on the inner surface of the rear substrate 102 and inner walls of the barrier ribs 103.

The barrier ribs 103 of the discharge cells include a raw material for forming a phosphor layer that corresponds to a phosphor layer having relatively low luminous efficiency, which will now be described in detail.

The barrier ribs 103 are formed between the front and rear substrates 101 and 102. The barrier ribs 103 are formed of a dielectric material that can induce charges during discharges, and preferably, the dielectric material is glass powder to which an organic vehicle and various fillers, such as, for example, $ZrO_2$, $TiO_2$ or $Al_2O_3$ are added. The first barrier ribs 104 are disposed between the adjacent second barrier ribs 105, and are combined to one unit with the second barrier ribs 105 by extending away from the inner walls of the second barrier ribs 105.

The phosphor layers 116 are formed in the discharge cells defined by the barrier ribs 103, and in the current embodiment, the phosphor layers 116 include a red phosphor layer 116R (see FIG. 2), a green phosphor layer 116G, and a blue phosphor layer 116R, but not limited thereto.

The red color phosphor layer 116R may be formed of $(Y,Gd)BO_3;Eu^{+3}$, the green color phosphor layer 116G may be formed of $Zn_2SiO_4:Mn^{2+}$, and the blue color phosphor layer 116B may be formed of $BaMgAl_{10}O_{17}:Eu^{2+}$. Alternately, the blue color phosphor layer 116B can be formed of $CaMgSi_2O_8:Eu^{2+}$. (The $CaMgSi_2O_8:Eu^{2+}$ is an organic compound of Ca, $MgO_6$, and $SiO_4$.)

In some examples, the plasma display panel 100 has a low color temperature due to the blue color phosphor layer 116B coated on the blue color discharge cell B having relatively low luminous efficiency compared to the red color phosphor layer 116R coated in the red color discharge cell R and the green color phosphor layer 116G coated in the green color discharge cell G.

To prevent the low color temperature of the plasma display panel 100, a raw material 103*b* for forming the blue color phosphor layer 116B is mixed in a raw material 103*a* for forming the barrier ribs 103. That is, the barrier ribs 103 are formed of a glass powder to which an organic vehicle and various fillers, such as, for example, $ZrO_2$, $TiO_2$ or $Al_2O_3$ are added. The raw material 103*b* for forming the blue color phosphor layer 116B can be a mixture of $CaMgSi_2O_8:Eu^{2+}$ with at least one of $BaMgAl_{10}O_{17}:Eu^{2+}$, $CaMgSi_2O_8:Eu^{2+}$, and $BaMgAl_{10}O_{17}:Eu^{2+}$.

The raw material 103*b* for forming the blue color phosphor layer 116B can be mixed with the entire barrier ribs 103 that define red, green, and blue discharge cells, or can be selectively mixed with the barrier ribs 103 that surround the blue color discharge cell B.

A method of manufacturing the barrier ribs 103 of the plasma display panel 100 having the above structure according to the current embodiment will now be described.

A rear substrate 102 formed of glass is prepared. Stripe shaped address electrodes 115 are patterned on an upper surface of the rear substrate 102 using a material having conductivity. Next, the address electrodes 115 are buried by printing a rear dielectric layer 114.

Next, a screen having substantially the same pattern as the barrier ribs 103 is tightly contacted on an upper surface of the rear dielectric layer 114. A paste is manufactured by mixing a raw material for forming the barrier ribs, formed of glass powder to which an organic vehicle and various fillers, such as, for example, $ZrO_2$, $TiO_2$ or $Al_2O_3$ are added with a raw material 103*b* for forming a blue color phosphor layer, formed of one mixture, for example, $BaMgAl_{10}O_{17}:Eu^{2+}$, $CaMgSi_2O_8:Eu^{2+}$, or a mixture of $CaMgSi_2O_8:Eu^{2+}$ and $BaMgAl_{10}O_{17}:Eu^{2+}$. The paste is printed on the screen and baked to complete the manufacture of the barrier ribs 103.

An exemplary operation of the plasma display panel 100 having the above structure will now be described.

When a predetermined pulse voltage from an external power source is applied between address electrodes 114 and a Y electrode 107, discharge cells that emit light are selected. Wall charges are accumulated on an inner surface of the selected discharge cells.

Next, when a positive (+) voltage is applied to an X electrode 106 and a relatively higher voltage that the voltage applied to the X electrode 106 is applied to a Y electrode 107, wall charges migrate due to a voltage difference between the X and Y electrodes 106 and 107.

Plasma is generated by the collision between the moving wall charges and discharge gas atoms in the discharge cells. The discharge begins at a gap where a relatively strong field is formed between the X and Y electrodes 106 and 107 and expands outwards.

When the voltage difference between the X and Y electrodes 106 and 107 is reduced lower than a discharge voltage due to the discharge, a further discharge is not generated, but space charges and wall charges are formed in the discharge cell.

When the polarity of the voltages applied to the X and Y electrodes 106 and 107 is reversed, discharge is re-generated with the aid of the wall charges. If the polarity of the X and Y electrodes 106 and 107 is reversed again, the initial discharge process is repeated. Discharge is stably generated by repeating this process.

Ultraviolet rays generated by the discharge excite a phosphor material included in the phosphor layers 116 coated in each of the discharge cells. Through this process, visible light is generated. The generated visible light displays stationary images or moving images by emission from the discharge cells.

Since the raw material 103*b* for forming a blue color phosphor layer 116B is mixed in the barrier ribs 103, energy enters into the barrier ribs 103 and the raw material 103*b* for forming a blue color phosphor layer 116B generates blue light. Accordingly, blue light is generated in the red, green, and blue color discharge cells. The generation of blue light in the red, green, and blue color discharge cells can compensate for the emission of blue light from the blue color discharge cells B that have relatively low luminous efficiency, and can increase a color temperature of the entire plasma display panel 100. The addition of the raw material 103*b* for forming a blue color phosphor layer 116B to the barrier ribs 103 may be in a range that the color mixing of the red and green color discharge cells R and G does not occur due to the other color. Also, the raw material 103*b* for forming a blue color phosphor layer 116B may be appropriately added to the barrier ribs 103 so as not to affect the light emission of the red color discharge cells R which have a relatively low brightness compared to the green color discharge cells G. The mixing ratio of the raw material 103*b* for forming a blue color phosphor layer 116B with respect to the barrier ribs 103 may be from about 1 to about 20%, preferably, from about 5 to about 10%.

Experimental results of the luminous efficiency of blue color and the variation of color temperature are summarized in Table 1.

TABLE 1

| | Comparative Example | | | | Example | | | |
|---|---|---|---|---|---|---|---|---|
| | X | Y | Brightness | Color temperature | X | Y | Brightness | Color temperature |
| Full white | 0.276 | 0.287 | 195.5 | 10685 | 0.275 | 0.272 | 196.7 | 12108 |
| Full blue | 0.148 | 0.047 | 37.48 | — | 0.153 | 0.056 | 49.2 | — |
| Blue color efficiency | | | 100% | | | | 110.4% | |

For the comparative example, conventional barrier ribs are used, and for the current embodiment, barrier ribs into which a raw material for forming a blue color phosphor layer is mixed.

Referring to Table 1, in the case of the comparative example, X axis and Y axis of a color coordinate respectively are 0.276 and 0.287, brightness is 195.5, and color temperature is 10685 K, and in the case of the current embodiment, X axis and Y axis of a color coordinate respectively are 0.275 and 0.272, brightness is 196.7, and color temperature is 12108 K. That is, this exemplary embodiment has a color temperature improvement of approximately 1400 K compared to the comparative example. Also, the blue color efficiencies (brightness/Y) of the comparative example and the exemplary embodiment respective are 797.4 and 878.5. Assuming that the blue color efficiency of the comparative example is 100, that of the exemplary embodiment is 110.4, that is, the exemplary embodiment has the blue color efficiency improvement of 10.4%.

As described above, a plasma display panel according to the present embodiments can increase luminous efficiency of discharge cells that have low luminous efficiency and can increase color temperature at full white by manufacturing barrier ribs mixing with a raw material for forming a phosphor layer that has relatively low luminous efficiency.

While the present embodiments have been particularly shown and described with reference to exemplary embodiments thereof, it will be understood by those of ordinary skill in the art that various changes in form and details may be made therein without departing from the spirit and scope of the present embodiments as defined by the following claims.

What is claimed is:

1. A plasma display panel comprising:

a plurality of substrates facing each other;

a plurality of discharge electrodes disposed within the substrates;

barrier ribs which are disposed between the substrates and define discharge cells; and a plurality of phosphor layers coated in the discharge cells, wherein a raw material for forming at least one phosphor layer of the phosphor layers is mixed into the barrier ribs.

2. The plasma display panel of claim 1, wherein the raw material for forming the at least one phosphor layer mixed into the barrier ribs is one that has relatively low luminous efficiency.

3. The plasma display panel of claim 2, wherein the phosphor layers comprise red, green, and blue phosphor layers, and the raw material for forming the phosphor layer mixed with the barrier ribs is a raw material for forming a blue color phosphor layer.

4. The plasma display panel of claim 3, wherein the raw material for forming a blue color phosphor layer is mixed in the barrier ribs that define the blue color discharge cells.

5. The plasma display panel of claim 3, wherein the raw material for forming a blue color phosphor layer is mixed in substantially all of the barrier ribs that define the discharge cells.

6. The plasma display panel of claim 4, wherein the raw material for forming a blue color phosphor layer is $BaMgAl_{10}O_{17}:Eu^{2+}$, or $CaMgSi_2O_8:Eu^{2+}$ or a mixture of $BaMgAl_{10}O_{17}:Eu^{2+}$ and $CaMgSi_2O_8:Eu^{2+}$.

7. A plasma display panel comprising:

a front substrate;

a rear substrate facing the front substrate;

a plurality of discharge electrodes disposed in he front and rear substrates;

a dielectric layer that buries the discharge electrodes;

a protective layer formed on the surface of the dielectric layer;

barrier ribs disposed between the front and rear substrate to define discharge cells; and phosphor layers of red, green, and blue color coated in the discharge cells, wherein a raw material for forming at least one phosphor layer of the phosphor layers of red, green, and blue color is mixed into the barrier ribs.

8. The plasma display panel of claim 7, wherein a raw material for forming a blue color phosphor layer is mixed into the barrier ribs.

9. The plasma display panel of claim 8, wherein the raw material for forming a blue color phosphor layer is mixed into the barrier ribs that define the blue color discharge cells.

10. The plasma display panel of claim 8, wherein the raw material for forming a blue color phosphor layer is mixed into substantially all of the barrier ribs that define the discharge cells.

11. The plasma display panel of claim 8, wherein the mixing ratio of the raw material for forming a blue color phosphor layer is from about 1 to about 20% of the total raw material for forming the barrier ribs.

12. The plasma display panel of claim 7, wherein the barrier ribs comprise a plurality of first barrier ribs disposed in a direction of the substrate and a plurality of second barrier ribs disposed in another direction of the substrate, wherein the first barrier ribs are disposed between the adjacent second barrier ribs, and are combined to one unit with the second barrier ribs by extending away from inner walls of the second barrier ribs.

13. The plasma display panel of claim 8, wherein the raw material for forming a blue color phosphor layer is $BaMgAl_{10}O_{17}:Eu^{2+}$ or $CaMgSi_2O_8:Eu^{2+}$ or a mixture of $BaMgAl_{10}O_{17}:Eu^{2+}$ and $CaMgSi_2O_8:Eu^{2+}$.

* * * * *